US005769623A

United States Patent [19]

Lake et al.

[11] Patent Number: 5,769,623

[45] Date of Patent: Jun. 23, 1998

[54] OIL FIRED BURNER

[75] Inventors: Graham Albert John Lake, Wellington; Guy David Lowman, Henyock, both of United Kingdom

[73] Assignee: Don Heating Products Limited, United Kingdom

[21] Appl. No.: 553,487

[22] PCT Filed: May 20, 1994

[86] PCT No.: PCT/GB94/01088

§ 371 Date: Jul. 29, 1996

§ 102(e) Date: Jul. 29, 1996

[87] PCT Pub. No.: WO94/28358

PCT Pub. Date: Dec. 8, 1994

(Under 37 CFR 1.47)

[30] Foreign Application Priority Data

May 20, 1993 [GB] United Kingdom ..... 9310392

[51] Int. Cl.[6] ..... F24C 5/08; F23K 5/22; F23D 5/04

[52] U.S. Cl. ..... 431/125; 431/170; 431/333; 431/340; 126/512

[58] Field of Search ..... 431/125, 126, 431/7, 331, 332, 333, 334, 335, 336, 337, 339, 340; 126/95, 512, 500, 503, 93, 96, 97, 92 R, 92 AC, 92 B, 92 C

[56] References Cited

U.S. PATENT DOCUMENTS

| | | | |
|---|---|---|---|
| 258,922 | 6/1882 | Holland | 126/512 |
| 390,194 | 9/1888 | Vogel . | |
| 416,876 | 12/1889 | Vogel . | |
| 1,470,379 | 10/1923 | Kresser | 431/328 |
| 2,072,048 | 2/1937 | Leonard | 126/95 |
| 3,817,686 | 6/1974 | Quittner . | |
| 3,993,430 | 11/1976 | Forker | 431/125 |
| 4,000,732 | 1/1977 | White | 126/512 |
| 4,487,572 | 12/1984 | Parker . | |
| 4,582,478 | 4/1986 | Hilker . | |
| 4,637,372 | 1/1987 | Mogol et al. . | |
| 5,026,271 | 6/1991 | Orov et al. | 126/512 |
| 5,118,539 | 6/1992 | Sebby et al. . | |

FOREIGN PATENT DOCUMENTS

| | | | |
|---|---|---|---|
| 0090419 | 10/1983 | European Pat. Off. . | |
| 0239008 | 9/1987 | European Pat. Off. . | |
| 0 409 371 | 8/1992 | European Pat. Off. . | |
| 1 602 980 | 4/1971 | France . | |
| 3126186 | 5/1982 | Germany | 126/512 |
| 0263052 | 1/1985 | Japan | 126/92 AC |
| 40-3233213 | 10/1991 | Japan | 126/512 |
| 210842 | 2/1924 | United Kingdom . | |
| 429115 | 12/1933 | United Kingdom . | |
| 1378022 | 1/1972 | United Kingdom . | |
| 1378027 | 10/1972 | United Kingdom . | |
| 408731 | 1/1991 | United Kingdom . | |

OTHER PUBLICATIONS

WO 8303459, Backstrom, U.S. CL.–431/340, Oct. 1983.
EP 0096111, Fox, U.S.CL.–431/125, Dec. 1983.

*Primary Examiner*—Carl D. Price
*Attorney, Agent, or Firm*—Barnes & Thornburg

[57] ABSTRACT

The burner comprises a cylindrical body defining an oil vaporizing chamber, an inlet on the body for oil, and inlet on the body for air and a bed of imitation fuel such as ceramic briquettes. The bed of imitation fuel receives vapor from the chamber for combustion around the imitation solid fuel. Heat generated by such combustion is arranged to vaporize oil in the chamber received rom the oil inlet.

20 Claims, 2 Drawing Sheets

OIL FIRED BURNER

FIELD OF INVENTION

The invention relates to an oil fired burner.

BACKGROUND AND SUMMARY OF THE INVENTION

In recent years, live flame effect fires have gained popularity but require the use of a gas supply. In certain locations, a mains gas supply is not available and there are, moreover, cases where users prefer to heat their homes with an alternative fuel. An object of the present invention is to provide an oil fired burner which will enable a live fuel effect to be obtained.

According to a first aspect of the invention, there is provided an oil fired burner comprising a body defining an oil vaporising chamber, an inlet in the body for oil, an inlet in the body for air and a bed of imitation solid fuel which receives vapour from the chamber for combustion around the imitation solid fuel, heat generated by such combustion being arranged to vaporise oil in the chamber received from the oil inlet.

Vaporising means may be provided for initially vaporising oil entering the chamber through the inlet to provide an initial supply of vapour for combustion around the imitation solid fuel.

According to a second aspect of the invention there is provided an oil fired burner comprising a body defining an oil vaporising chamber, an inlet in the body for oil, an inlet in the body for air and a bed of imitation solid fuel, whereby oil vaporised in the chamber will enter the fuel bed for combustion around the imitation solid fuel, vaporising means being provided for initially vaporising oil entering the chamber through the inlet to provide an initial supply of vapour for combustion around the imitation solid fuel.

The means for initially vaporising oil entering the chamber may comprise a wick in the chamber on which oil is burned.

The combustion of the vapour around the imitation solid fuel will provide the desired live flame effect. The bed of imitation solid fuel may comprise a plurality of ceramic blocks, in the shape of pieces of coal or small logs. Conveniently the bed may comprise a pre-assembled arrangement of ceramic blocks or a pre-moulded ceramic bed.

Conveniently, the imitation fuel bed may be arranged above the chamber, eg carried on baffle means extending across the chamber and which permits the vaporised oil to pass therethrough.

The burner may be arranged within an enclosure such as walling of a stove which may include means such as an adjustable valve or the like to control admission of air to the vaporised oil around the imitation solid fuel. Where such a valve is provided, it may be in the form of a simple air flap which can be moved between open and closed positions.

In a burner according to the second aspect of the invention, vaporisation of fuel subsequently entering the chamber is preferably effected by heat generated as a result of combustion of the vapour around the imitation solid fuel.

To inhibit heat loss from the chamber, the body may be provided with insulation means such as ceramic insulation surrounding the body.

The body may comprise inner and outer walls which define a space therebetween for receiving air from the air inlet. The inner wall is preferably formed with inlet porting for enabling primary air to enter the chamber from the said space.

In a preferred embodiment, a flame ring may be provided in the chamber to control mixing of vapour and air in the chamber and/or the movement of vapour and air through the chamber.

The body is preferably disposed such that the wick, where provided, is arranged at the bottom of the chamber and the imitation solid fuel is arranged at the top of the burner spaced from the wick.

Ignition means may be provided on the body for initially igniting the oil on the wick.

Control means may be provided for controlling flow of oil to the burner, the control means preferably enabling the oil to be fed to the burner to maintain the burner at a low output setting when required.

The air inlet porting may also be arranged to admit secondary air into the chamber. In such a case the porting may admit the secondary air into an annular passage leading to an outlet adjacent the imitation solid fuel whereby air passing through the outlet will aid combustion of the vaporised oil around the imitation solid fuel.

The invention also includes an appliance including a burner in accordance with the first or second aspect of the invention or any of the consistory clauses related thereto.

BRIEF DESCRIPTION OF THE INVENTION

An oil fired burner in accordance with the invention will now be described by way of example with reference to the accompanying drawings in which:

FIG. 1 is a diagrammatic cross-section through a preferred form of oil-fired burner in accordance with the invention and FIG. 2 is a cross-section through the burner of FIG. 1 on line II—II in FIG. 1.

DETAILED DESCRIPTION OF THE INVENTION

Figure 1:
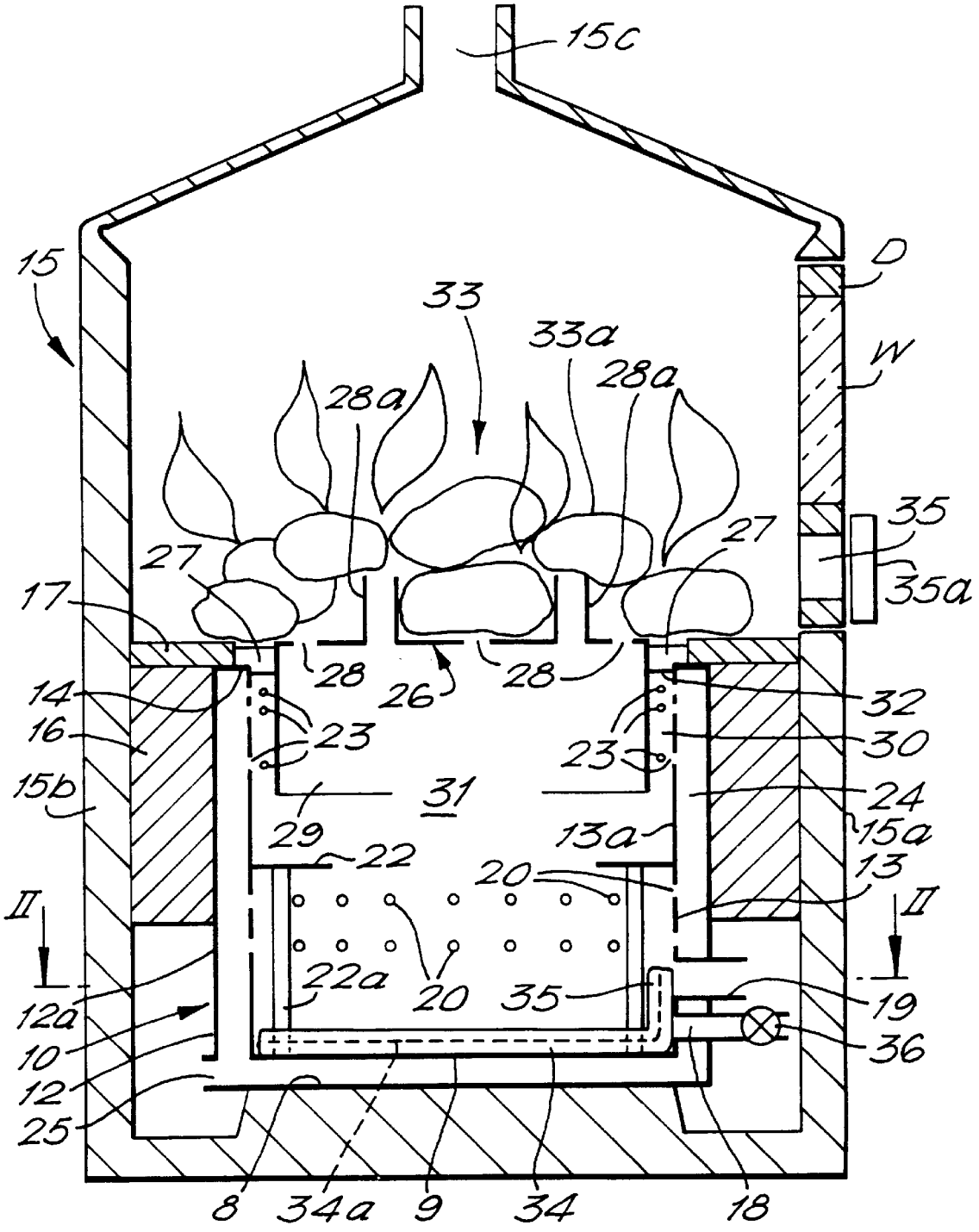
Figure 2:
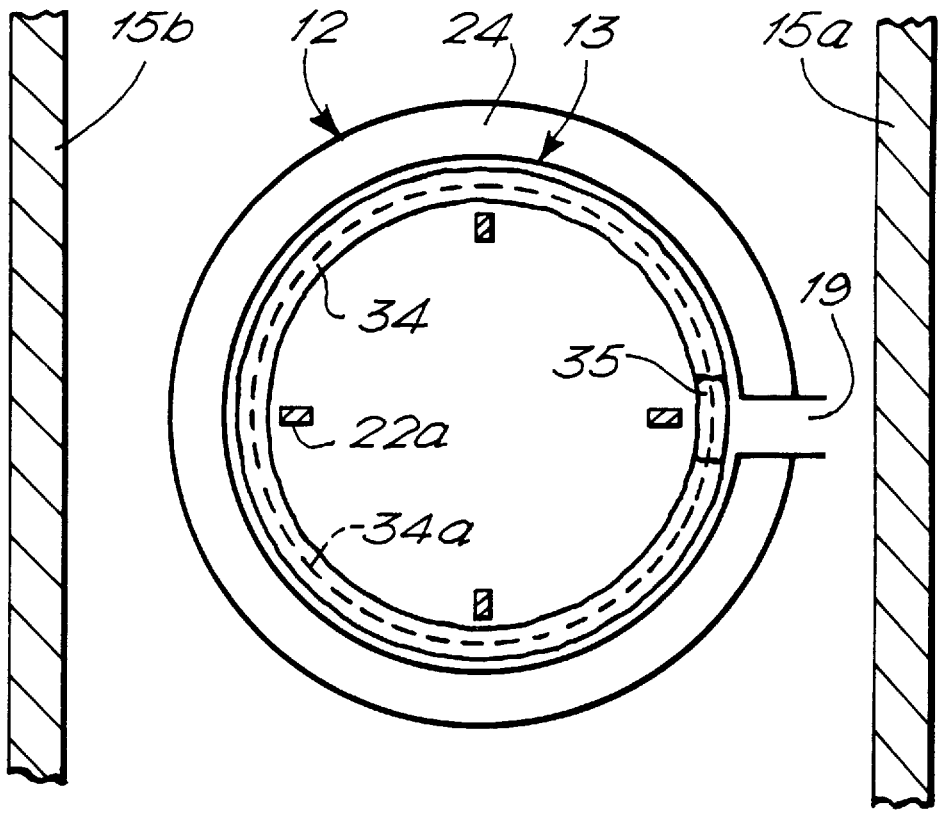

The burner has a cylindrical body 10 comprising outer and inner pots 12, 13 having respective closed lower ends 8, 9 spaced from each other.

The upper end of the inner pot 13 is provided with an outwardly extending annular rim 14 which is connected to the upper end of outer pot 12.

The outer pot 12 forms an outer wall 12*a* of the body 10 which carries an annular layer of ceramic insulation 16. The upper surface of the layer of insulation 16 carries a further annular layer of ceramic insulation 17 extending on to the rim 14.

The inner pot 13 defines an inner wall 13*a* of the body 10 and is formed with an oil inlet 18 and a lighting port 19. The inner wall 13*a* is also formed with a plurality of ports 20 above the lighting port 19 and immediately beneath a removable sheet metal annular flame ring 22. The flame ring is supported on legs 22*a* which rest on the closed end 9 of the inner pot 13. The inner wall 13*a* is also formed with further ports 23 above the flame ring 22. The ports 20, 23 receive air from a space 24 between the outer and inner walls 12*a,* 13*a* and the space itself receives air from a main air inlet 25 in the outer pot 12.

The annular rim 14 supports a baffle 26. The baffle 26 has sheet metal radial lugs 27 which rest on the annular rim 14 inside the annular insulation layer 17. The baffle 26 is formed with a plurality of outlet apertures and tubes 28, 28*a* respectively and carries a downwardly extending cylindrical member 29 coaxial with the inner wall 13*a* of the body 10. The inner wall 13*a* and the member 29 define therebetween an annular passage 30 which receives air from the ports 23 and defines an annular outlet 32 at its upper end.

The baffle 26 supports a bed 33 of ceramic elements 33*a* to imitate solid fuel such as coal, logs, briquettes or the like. The tubes 28*a* help to support the ceramic elements 33*a*. The bed 33 may alternatively take the form of a one-piece moulding resting on the baffle 26 to avoid the use of individual ceramic elements 33*a*.

The inner pot 13 and the baffle 26 together define an oil vaporising chamber 31.

At the lower end 9 of the inner pot 13 an ignition wick 34 is disposed. The wick 34 is generally ring-like and is carried by a ring-like support member 34*a*. The wick 34 has an upturned section 35 opposite the lighting port 19.

The pots 12, 13, the flame ring 22 and legs 22*a*, the baffle 26 and legs 27, the cylindrical member 29 and wick support member 34*a* are constructed from a stainless steel capable of withstanding temperatures of around 750° C.

The burner is carried within an appliance such as a stove indicated generally at 15 which has front and rear walls 15*a*, 15*b*, side walls (not shown) and a suitably disposed flue 15*c*. The front wall 15*a* includes a normally closed door D having a window W therein and also an air inlet 35 adjustable by a flap 35*a* or other suitable valve. A suitable inlet on the stove enables air to reach the inlet 25.

In use, oil enters the inner pot 13 via the inlet port 18 and is initially absorbed by the ignition wick 34. The oil on the wick is then ignited via the lighting port 19. The lighting may either be performed by means of a manual operation or by a suitable electrical igniter (not shown).

Following ignition, a flame on the wick 34 spreads around the lower end of the inner pot 13 of the housing 10 and gradually heats the inner pot 13. The flame is supplied with primary combustion air through the ports 20. Further oil fed into the body 10 is heated by the flame and is vaporised in chamber 31, the vapour mixing with the primary air. Vaporisation of the oil increases as the temperature of the body 10 increases.

As the amount of vapour (which is heavier than air) increases in the chamber 31, the level of the vapour and flames gradually rises, the flames tending to lie at the upper outer edge of the vapour adjacent inner wall 13*a* of the inner pot 13. The flames/vapour around the edge gradually work their way up through the annular passage 30 and mix with some secondary air entering the passage 30 via apertures 23. The air entering the annular passage 30 helps to maintain the burning of vapour in that passage, the burning vapour heating the cylindrical member 29 which itself aids vaporisation of the oil entering the chamber 31. The flames in annular passage 30 eventually emerge through the annular outlet 32. At the same time vapour emerges through the apertures 28. The flame ring 22 helps to mix the vapour with primary air drawn through the ports 20 by the rising vapour and flames and also helps to control movement of the air/vapour mixture upwards through the chamber 31.

The presence of air in the imitation fuel bed 33 fed via apertures 23, 32 and the adjustable air inlet 35 in the front wall 15 provides sufficient secondary air to enable the flames to ignite the vapour above the baffle 26 in fuel bed 33 and provide a live flame effect with flames rising above the ceramic blocks 33*a* as shown.

The heat from burning oil on the wick 34 thus initially vaporises oil entering the chamber 31 to provide an initial supply of vapour for the fuel bed 33.

The temperature of the body 10 increases until there is no longer any flame below the baffle 26 but only an oil/air vapour, the temperature of the body 10 being maintained and the incoming oil continuously being vaporised by heat due to vapour combustion at the imitation fuel bed 33. Although oil vapour within the chamber 31 is mixed with a certain amount of primary air from the ports 20, the ports limit the amount of air entering the chamber and the vapour/air ratio is such that the vapour is non-combustible. Only when the vapour is allowed to mix with secondary air in the imitation fuel bed 33 fed via the adjustable air inlet 35 and the apertures 32 will the oil/air vapour mixture ignite. The air to oil vapour ratio in the chamber 31 in such a case does not exceed the stoichiometric value. For a given mass flow of oil eg 4 to 8.5 cc/min through the oil inlet 18 it is found that inlet ports 20 giving a total area of 197.5 mm2 with non-forced draft will provide a suitable air/vapour ratio in the chamber 31.

Once the temperature of the imitation fuel bed 33 rises due to the burning vapour, the live flame visual effect increases and combustion in the imitation fuel bed is improved giving zero or an acceptable minimum of sooting.

The oil entering the inlet 18 is preferably controlled by means of a valve 36 to control the amount of vapour burned in the imitation fuel bed 33. The valve 36 may be a simple high-flow/low-flow control. At the low-flow setting, the amount of vapour entering the imitation fuel bed 33 will be small but sufficient to maintain a "glow" from the ceramic blocks 33*a*. The heated baffle 26 normally glows red during operation of the burner and the low-flow setting will maintain a glow both from the imitation fuel bed 33 and the baffle 26.

Air passing through the inlet 25 may do so naturally or by forced draft eg by a suitably located fan.

Instead of the body 10 being cylindrical it could be of other shape such as rectangular.

Oil may initially be vaporised upstream of the oil inlet 18 or at some location other than in the chamber 31. The vapour can then be fed to the chamber 31 for providing an initial supply of vapour for combustion around the imitation solid fuel of the bed 33. In that way the use of a wick 34 is not necessary.

FIG. 1 shows the burner housed completely within the appliance 15. However there may be cases where the fuel bed 33 is positioned inside the appliance with the lever end of the burner including the oil inlet 18, lighting port 19 and the air inlet 25 positioned beneath the appliance and hidden behind a suitable cover or shroud.

I claim:

1. An oil fired burner comprising a body including a lower end and an upper end defining an oil vaporizing chamber in which an oil vapor is produced, an inlet in the body for oil, an inlet in the body for air through which air enters the oil vaporizing chamber for mixing with the oil vapor to provide an oil vapor/air ratio such that the oil vapor is non-combustible, a baffle positioned to lie adjacent the upper end, the baffle being sized to receive the flow of the non-combustible oil vapor/air mixture therethrough, an air outlet adjacent the baffle feeding secondary air to the non-combustible oil vapor/air mixture to provide a second vapor/air ratio such that the oil vapor is combustible, and a bed of imitation solid fuel positioned over the baffle, the bed of imitation solid fuel which receives the mixture of air and oil vapor from the oil vaporizing chamber and the air outlet for combustion around the imitation solid fuel, heat generated by such combustion being arranged to vaporize oil in the oil vaporizing chamber received from the oil inlet.

2. An oil fired burner according to claim 1 in which vaporising means is provided for initially vaporising oil entering the oil vaporising chamber through the inlet to provide an initial supply of the oil vapour for combustion around the imitation solid fuel.

3. An oil fired burner according to claim 2 in which the vaporizing means comprises a wick in the oil vaporising chamber on which the oil is burned.

4. An oil fired burner according to claim 3 in which the body is disposed such that the wick is arranged at the bottom of the oil vaporising chamber and the imitation solid fuel is spaced from the wick.

5. An oil burner according to claim 3 in which ignition means is provided on the body for initially igniting the oil on the wick.

6. An oil fired burner according to claim 1 in which the imitation fuel is carried on baffle means extending across the oil vaporising chamber and which permits the oil vapour to pass therethrough.

7. An oil fired burner according to claim 1 in which the body comprises inner and outer walls which define a space therebetween for receiving air from the air inlet.

8. An oil fired burner according to claim 7 in which the inner wall is formed with inlet porting for enabling primary air to enter the oil vaporising chamber from the said space.

9. An oil fired burner according to claim 1 in which a flame ring is provided in the oil vaporising chamber to control mixing of the vapour and air in the oil vaporising chamber.

10. An oil fired burner according to claim 1 in which control means is provided for controlling flow of the oil to the burner.

11. An oil fired burner according to claim 10 in which the control means enables the oil to be fed to the burner to maintain the burner at a low output setting when required.

12. An oil fired burner according to claim 1 in which air inlet porting is provided for enabling primary and secondary air to enter the oil vaporising chamber.

13. An oil fired burner according to claim 1 in which the burner is arranged at least partly within an enclosure such as a stove or other appliance.

14. An oil fired burner according to claim 13 in which the enclosure includes adjustable admission means to control admission of air to the vapour oil around the imitation solid fuel.

15. An oil fired burner according to claim 14 in which the admission means is in the form of a valve movable between open and closed positions.

16. An oil fired burner according to claim 1 in which the bed of imitation solid fuel comprises a ceramic block arrangement.

17. An oil fired burner according to claim 1 in which the body is provided with insulation means to inhibit heat loss from the chamber.

18. An oil fired burner comprising a body including a lower end and an upper end defining an oil vaporizing chamber in which an oil vapor is produced, an inlet in the body for oil, an inlet in the body for air through which air enters the oil vaporizing chamber for mixing with the oil vapor in the vaporizing chamber to provide an oil vapor/air ratio such that the oil vapor is non-combustible, a baffle including an inner end facing the vaporizing chamber, an opposite outer end, and an aperture sized to receive the flow of the non-combustible oil vapor/air mixture therethrough, an air outlet adjacent the baffle feeding secondary air to the non-combustible oil vapor/air mixture to provide a second vapor/air ratio adjacent the outer end of the baffle such that the oil vapor is combustible, and a bed of imitation solid fuel positioned across the oil vaporizing chamber, whereby the mixture of air and the oil vapor will enter the fuel bed for combustion around the imitation solid fuel, vaporizing means being provided for initially vaporizing oil entering the oil vaporizing chamber through the inlet to provide an initial supply of the oil vapor for combustion around the imitation solid fuel.

19. An oil fired burner comprising a body defining an oil vaporizing chamber in which an oil vapor is produced, an inlet in the body for air through which air enters the oil vaporizing chamber for mixing with the oil vapor, and a bed of imitation solid fuel positioned over the oil vaporizing chamber which receives the mixture of air and oil vapor from the oil vaporizing chamber from combustion around the imitation solid fuel, heat generated by such combustion being arranged to vaporize oil in the oil vaporizing chamber received from the oil inlet, air inlet porting for enabling primary and secondary air to enter the oil vaporizing chamber and an outlet defined adjacent the imitation solid fuel, the porting admitting the secondary air into a passage leading to the outlet whereby air passing through the outlet will aid combustion of the vapor around the imitation solid fuel.

20. An oil fired burner comprising a body defining an oil vaporing chamber in which an oil vapor is produced, an inlet in the body for air through which air enters the oil vaporizing chamber for mixing with the oil vapor, and a bed of imitation solid fuel positioned one the oil vaporizing chamber which receives the mixture of air and oil vapor from the oil vaporizing chamber for combustion around the imitation solid fuel, heat generated by such combustion being arranged to vaporize oil in the oil vaporizing chamber received from the oil inlet, air inlet porting for enabling primary and secondary air to enter the oil vaporizing chamber an outlet defined adjacent the imitation solid fuel, the porting admitting the secondary air into a passage leading to the outlet whereby air passing through the outlet will aid combustion of the vapor around the solid fuel, the passage being arranged between a wall surrounding the oil vaporizing chamber and a member spaced inwardly of the wall.

* * * * *